US006315601B1

(12) United States Patent
Sasaki et al.

(10) Patent No.: US 6,315,601 B1
(45) Date of Patent: Nov. 13, 2001

(54) DOUBLE LOCK CONNECTOR AND SPACER DETECTING METHOD THEREFOR

(75) Inventors: Yasuhiro Sasaki; Hiroshi Yamamoto, both of Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/597,222

(22) Filed: Jun. 20, 2000

(30) Foreign Application Priority Data

Jun. 21, 1999 (JP) ..... 11-174173

(51) Int. Cl.[7] ..... H01R 3/00
(52) U.S. Cl. ..... 439/488; 439/752
(58) Field of Search ..... 439/752, 595, 439/488, 910

(56) References Cited

U.S. PATENT DOCUMENTS 4,804,341 2/1989 Kato et al. ..... 439/733
5,586,917 * 12/1996 Yagi et al. ..... 439/752
5,609,503 * 3/1997 Tsuji et al. ..... 439/752
5,797,772 * 8/1998 Sakurai et al. ..... 439/752
5,839,923 * 11/1998 Yoshida ..... 439/752

FOREIGN PATENT DOCUMENTS 62-188186 8/1987 (JP) .

* cited by examiner

*Primary Examiner*—Gary Paumen
(74) *Attorney, Agent, or Firm*—Armstrong, Westerman, Hattori, McLeland & Naughton, LLP

(57) ABSTRACT

A double lock connector 1 having spacers 3,4 for engaging terminals is provided with detecting pin inserting portions 16,17 continuing from the front end of a connector housing 2 to the spacers 3,4. The detecting pin inserting portions are of slits. The detecting pin inserting portions 16,17 communicate with respective accommodating recesses 13,14 for base plate portions 9,10 of the spacers 3,4. Detecting pins are arranged opposite to the front end of the connector housing 2, and the detecting pins are inserted into the detecting pin inserting portions and abut against the respective spacers 3,4. The detecting pins are set inside a continuity testing portion of a terminal continuity testing member, and the continuity testing portion is moved toward the front end of the double lock connector 1. Thus, the presence of the spacers is securely detected.

6 Claims, 5 Drawing Sheets

DOUBLE LOCK CONNECTOR AND SPACER DETECTING METHOD THEREFOR

BACKGROUND OF THE INVENTION

1. Field of the Invention

The present invention relates generally to a double lock connector, and more particularly to a double lock connector, which has a pair of detecting pin inserting portions for detecting the presence of a pair of terminal-engaging spacers to be inserted in a connector housing of the connector, and a detecting method for the spacers.

2. Description of the Related Art

FIG. 6 shows a conventional double lock connector disclosed in Japanese Patent Application Laid-open No. 62-188186.

This double lock connector (hereinafter, a connector) 55 is made up of a male connector housing 56 made of synthetic resin, terminals 57,58 each having electric wire and to be inserted into a terminal accommodating chamber of the connector housing 56, and a pair of side spacers (hereinafter, spacers) 59,60 of synthetic resin for double-locking the terminals, which spacers are inserted into the connector housing 56 from a direction crossing at right angles to an inserting direction of the terminal 57,58.

The spacers 59,60 each are formed of a rectangular base plate portion 61 and a plurality of combtooth-like engaging rods 62 protrusively-provided on the base plate portion 61. The length and thickness of the respective engaging rods 62 are different according to size, shape, and location of the terminals 57,58. Accommodation grooves 64 for the respective base plate portions 61 of the spacers 59,60 and insertion holes 65 for the engaging rods 62 are formed on the longer sidewalls 63 of the connector housing 56. The insertion holes 65 are provided on a bottom of the accommodation groove 64, which accommodation groove 64 continues without limited by shorter sidewalls 66. That is, both ends 64*a* of the accommodation groove 64 are positioned on the respective shorter sidewalls 66.

The terminals 57,58 are of female terminals and have respective electrically contacting portions 67,68 on the front half thereof and connecting portions 69,70, on the rear half thereof, on which electric wires 71,72 are pressure-weld. The terminals 57,58 are inserted into the terminal accommodating chamber from the back of the connector housing 56 and are engaged with resilient engaging lances (not illustrated) at respective engaging portions 73. Subsequently, the spacers 59,60 are inserted, and the engaging rods 62 abut against the rear ends of the electrically contacting portions 67,68 of the terminals 57,58. Therefore, the terminals 57,58 are double locked, and coming-off of the terminals 57,58 caused by the withdrawal of electric wires 71,72 is completely prevented.

The terminals 57,58 may be inserted into the respective terminal accommodating chambers with the spacers 59,60 being in a state of provisional engagement (i.e. semi-insertion) with the connector housing 56, and then the spacers 59,60 may be finally engaged (i.e. complete insertion) with the connector housing 56. When the terminals 57,58 are inserted into the terminal accommodating chambers of the connector housing 56, if the terminals 57,58 are in a state of the incomplete insertion, the ends of the engaging rods 62 of the spacers 59,60 abut against the electrically contacting portions 67,68 of the terminals 57,58. That is, because the spacers 59,60 can not be inserted into the connector housing 56, the incomplete insertion of the terminals 57,58 can be detected.

The above connector 55 is coupled to the mating female connector (not illustrated), and male terminals (not illustrated) provided inside a connector coupling chamber of the female connector are inserted into front openings 74,75 of the terminal accommodating chambers of the connector housing 56 so as to be connected with the electrically contacting portions 67,68 of the terminals 57,58. A nut portion 76 to make a screw connection with the mating connector is arranged at the center of the connector housing 56.

FIG. 7 shows a spacer detecting method of the above double lock connector 55. This spacer detecting method is carried out with use of a terminal continuity testing member 78. A pair of detection switches 81 each having a detecting pin 80 are provided on lower portions of a connector holding portion 79 of the terminal continuity testing member 78, while opposing to a pair of spacers 59,60 inserted into the connector housing 56. A pair of detection switch 81 having the detecting pin 80 is provided with toward the lower part of the connector holding portion 79 of the terminal continuity testing member 78 oppositely to a pair of the spacer 59,60 inserted into inside the connector housing 56.

The terminal continuity testing member 78 is provided with the above connector holding portion 79 having a right-and-left pair of auxiliary guides 90, a continuity testing portion 82 capable of sliding in the axial direction and arranged opposite to the connector holding portion 79, horizontal guide bars 83 being put through the continuity testing portion 82, a link 84 connected to the continuity testing portion 82, and a lever 86 having a rotary portion 85 connected to the link 84. The above detecting pin 80 of the detection switch 81 is upwardly slidably provided on a bottom wall 87.

When the connector 55 is set on the connector holding portion 79 in a state that base plate portions 61 of the spacers 59,60 are in vertical, the ends 61*a* of the base plate portions 61 of the spacers 59,60 push the detecting pins 80 to activate the detection switches 81, whereby the presence of the spacers 59,60 is detected.

Probe pins 89 in the continuity testing portion 82 are inserted into the terminal accommodating chambers from the front openings 74,75 (FIG. 6) of the connector housing 56 by making the continuity testing portion 82 connect with the connector 55 by operating the lever 86 and come into contact with the front ends of the terminals 57,58 (FIG. 6), whereby a continuity test of the terminals 57,58 is carried out.

With respect to the above conventional double lock connector and the spacer detecting method therefor, however, because the accommodation grooves 64 for the base plate portions 61 of the spacers 59,60 are formed over the full width of the sidewalls 63, the rigidity of the connector housing 56 is likely to become weak. If the sidewalls 63 of the connector housing 56 are formed thicker in order to enhance the rigidity, the connector housing 56 is enlarged. And, the spacers 59,60 are enlarged because the base plate portions 61 have to be lengthened unnecessarily.

Also, in the terminal continuity testing member 78 of FIG. 7, because the detection switches 81 are arranged on the right-and-left lower portions of the connector holding portion 79, the terminal continuity testing member 78 is enlarged in height and width directions, whereby a big space is required, for example, when the wiring harness 88 is assembled and the handling becomes worse because of increase in the weight. If the pair of detection switches 81 are arranged in the auxiliary guides 90 instead of the bottom wall 87, the structure is further enlarged.

And, the presence of the spacers 59,60 is inspected and subsequently the continuity of the terminals 57,58 is tested, which requires time and trouble and makes the structure of the terminal continuity testing member 78 complicated, thereby raising the cost and making the structure enlarged. Further, the thin ends of the detecting pins 80 have to abut against the narrow ends of the spacers 59,60, the detecting accuracy is not good.

SUMMARY OF THE INVENTION

In view of the foregoing, an object of the present invention is to provide a double lock connector and a spacer detecting method therefor, wherein an enlargement of the connector and of a terminal continuity testing member caused by a detection mechanism for a pair of spacers can be prevented and the detection of the presence of the spacers can be securely carried out.

In order to achieve the above-described object, as a first aspect of the present invention, a double lock connector comprises: a connector housing having a terminal accommodating chamber and a front opening continuing to the terminal accommodating chamber; a terminal to be inserted into the terminal accommodating chamber; a spacer for engaging the terminal and to be inserted into the connector housing in a direction crossing a terminal inserting direction, wherein a detecting pin inserting portion continuing from a front surface of the connector housing to the spacer inserted into the connector housing is provided on the connector housing.

As a second aspect of the present invention, in the structure with the above first aspect, the detecting pin inserting portion is of a slit.

As a third aspect of the present invention, in the structure with either the above first or second aspect, the spacer is provided with a base plate portion, the connector housing is provided with an accommodating recess to accommodate the base plate portion, and the detecting pin inserting portion continues to the accommodating recess.

As a fourth aspect of the present invention, in the structure with the above third aspect, the connector housing is provided with a pair of said accommodating recesses and a pair of said detecting pin inserting portions continuing to the respective accommodating recesses.

As a fifth aspect of the present invention, a spacer detecting method for a double lock connector comprises the steps of: arranging a detecting pin oppositely to the front surface of the connector housing of the double lock connector with any one of the preceding aspects; inserting the detecting pin into the detecting pin inserting portion; and abutting the detecting pin against the spacer.

As a sixth aspect of the present invention, in the method with the above fifth aspect, the steps are carried out by setting the detecting pin in a continuity testing portion of a terminal continuity testing member and by shifting the continuity testing portion toward the front surface of the connector housing of the double lock connector.

As a seventh aspect of the present invention, in the method with the above fifth aspect, the detecting pin abuts against an end face of a base plate portion of the spacer at the abutting step.

According to the above-described structure of the present invention, the following advantages are provided.

(1) Because detection of the spacer can be carried out from the front of the connector housing, a spacer accommodation groove over the full width of the sidewall of the connector housing can be eliminated differently from the prior art connector, thereby the rigidity of the connector housing can be enhanced and the connector housing can be downsized.

(2) Because the slit can receive the detecting pin having a rather large size, an abutting surface therebetween can be large, thereby improving detection accuracy. And, because a position change of the detecting pin is permitted within the length of the slit, positioning of the connector with respect to the detecting pin can be rough, thereby facilitating the setting work of the connector.

(3) Because the detecting pin inserting portion is provided at the side portion of the connector housing, a structure of the connector housing can be simplified and its cost can be reduced. And, because the detecting pin abuts against the base plate portion through the slit, the detecting pin can be short, thereby ensuring smooth longitudinal movement thereof.

(4) The continuity test of a lot of terminals can be carried out effectively and detection of the presence of the spacers can be carried out effectively.

(5) Because the detection of the spacer can be carried out from the front of the connector housing, the detecting pin does not laterally protrude, thereby downsizing an inspection tool.

(6) Because both of detection of the presence of the spacer and a continuity test of the terminal can be simultaneously carried out with one operation to shift the continuity testing portion, the test can be facilitated and efficiency of the test can be improved. And, the detecting pin is arranged inside the continuity testing portion along with the terminal detecting pin, the terminal continuity testing member can be simplified, downsized, and lightweighted, thereby facilitating the handling of the terminal continuity testing member.

(7) Because the detecting pin abuts against the base plate portion of the spacer instead of abutting against the engaging rod of the spacer, deformation or wear of the detecting pin can be prevented.

The above and other objects and features of the present invention will become more apparent from the following description taken in conjunction with the accompanying drawings.

DESCRIPTION OF THE PREFERRED EMBODIMENT

An embodiment of the present invention will now be described in further detail with reference to the accompanying drawings.

Figure 1:
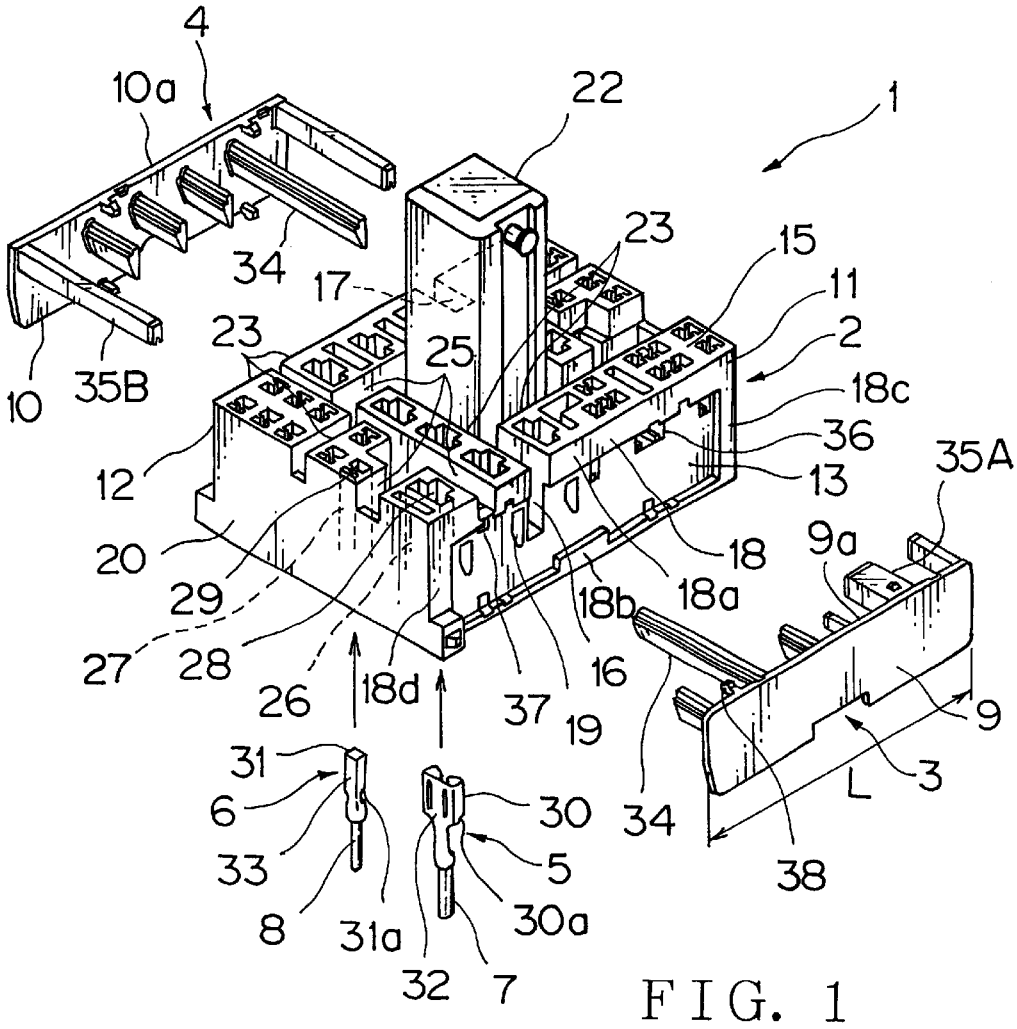
FIG. 1 is an exploded perspective view showing an embodiment of the double lock connector in accordance with the present invention.
Figure 2:
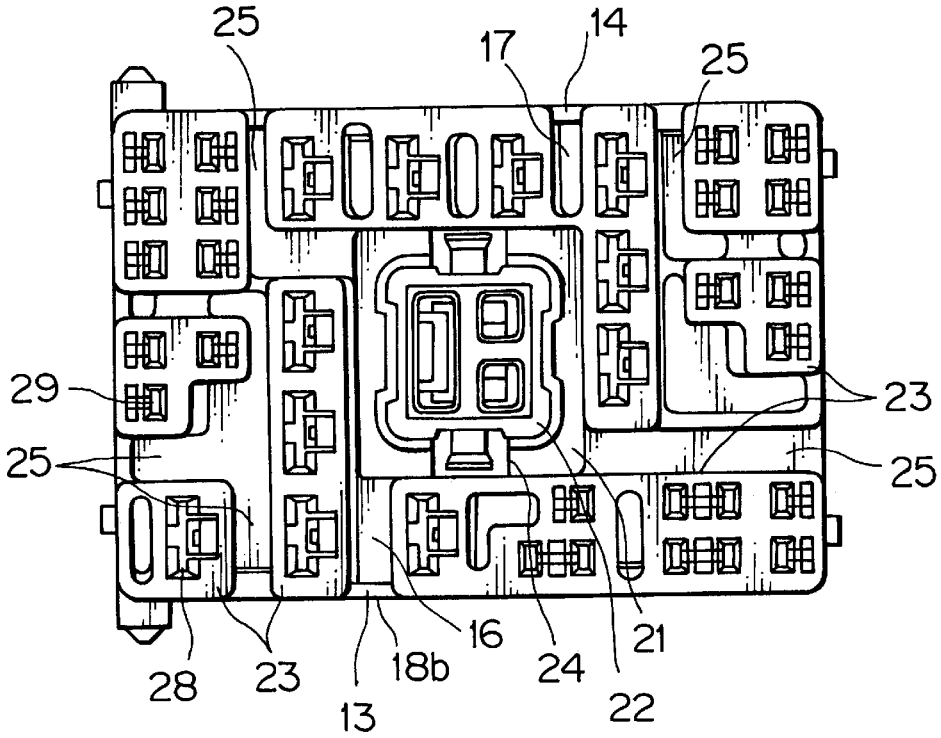
FIG. 2 is a plan view showing a connector housing of the double lock connector.

FIGS. 1 and 2 show an embodiment of the double lock connector in accordance with the present invention.

This the double lock connector 1, as shown in FIG. 1, is made up of a male connector housing 2 made of synthetic resin, a pair of side spacers (hereinafter, spacers) 3,4 made of synthetic resin, and female connectors 5,6 with respective electric wires. A length L of base plate portions 9,10 of the spacers 3,4 is set shorter than longer sidewalls 11,12 of the connector housing 2, the sidewalls 11,12 are provided with accommodating recesses 13,14 (FIG. 2) for the base plate portions 9,10, and slits (i.e. detecting pin inserting portions) 16,17 for spacer detection are formed in a connector coupling direction, namely from a front end surface 15 of the connector housing 2 to each of the accommodating recesses 13,14.

Each of the slits 16,17 is deeply formed until almost the center of each of the accommodating recesses 13,14. The slits 16,17 go through a frame wall (a frame-like portion) 18 of the connector housing 2, run along respective spacer insertion holes 19 (only one spacer insertion hole 19 is shown in FIG. 1), and open generally in a four-sided figure on respective bottom faces of the accommodating recesses 13,14. The slits 16,17 extend in parallel with respective shorter sidewalls 20 of the connector housing 2 and, namely, extend in a direction crossing at a right angle to the sidewalls 11,12. One slit 16 communicates with a central annular opening 21 (FIG. 2) of the connector housing 2, and the other slit 17 reaches the vicinity of the annular opening 21. Width of each of the slits 16,17 is around 3 mm, for example.

Inside the annular opening 21, a post portion 22 for screwing or tensioning coupling is formed, and the post portion 22 and a terminal accommodating portion 23 side, namely the housing body side, are integrally connected with connecting portions 24 (FIG. 2). The terminal accommodating portion 23 is divided into blocks by slits 25 therebetween. Two of a plurality of slits 25 are deeply formed to make the slits 16,17 for spacer detection.

Two kinds, small and large, of terminals 5,6 each having an electric wire are accommodated in the terminal accommodating portion 23. Front openings 28,29 of the terminal accommodating chambers 26,27 in the connector housing 2 are formed according to size and shape of the terminals 5,6. The female connector 5 is large and has an electrically contacting portion 30, and the female connector 6 is small and has a boxlike electrically contacting portion 31. The terminals 5,6 are inserted into the terminal accommodating chambers 26,27 in a state that base plate portions 32,33 are in parallel with the sidewall 20 of the connector housing 2.

On the bottom faces of the accommodating recesses 13,14 of the connector housing 2, insertion holes (i.e. engaging rod insertion holes) 19,36 for engaging rods 34,35A,35B, of various shapes, of the spacers 3,4 are formed. The engaging rod 34 having a wedgelike longitudinal section abuts against a rear end 30*a* of the electrically contacting portion 30 of the terminal 5, the engaging rod 35 having a rectangular longitudinal section abuts against a rear end 31*a* of the electrically contacting portion 31 of the small terminal 6, and the thick engaging rod 35A engages two lines of the terminals 6 simultaneously. An engaging claw 38 for an engaging hole 37 provided on each of the accommodating recesses 13,14 is protrusively-provided on each of the base plate portions 9,10 of the spacers 3,4.

Figure 6:
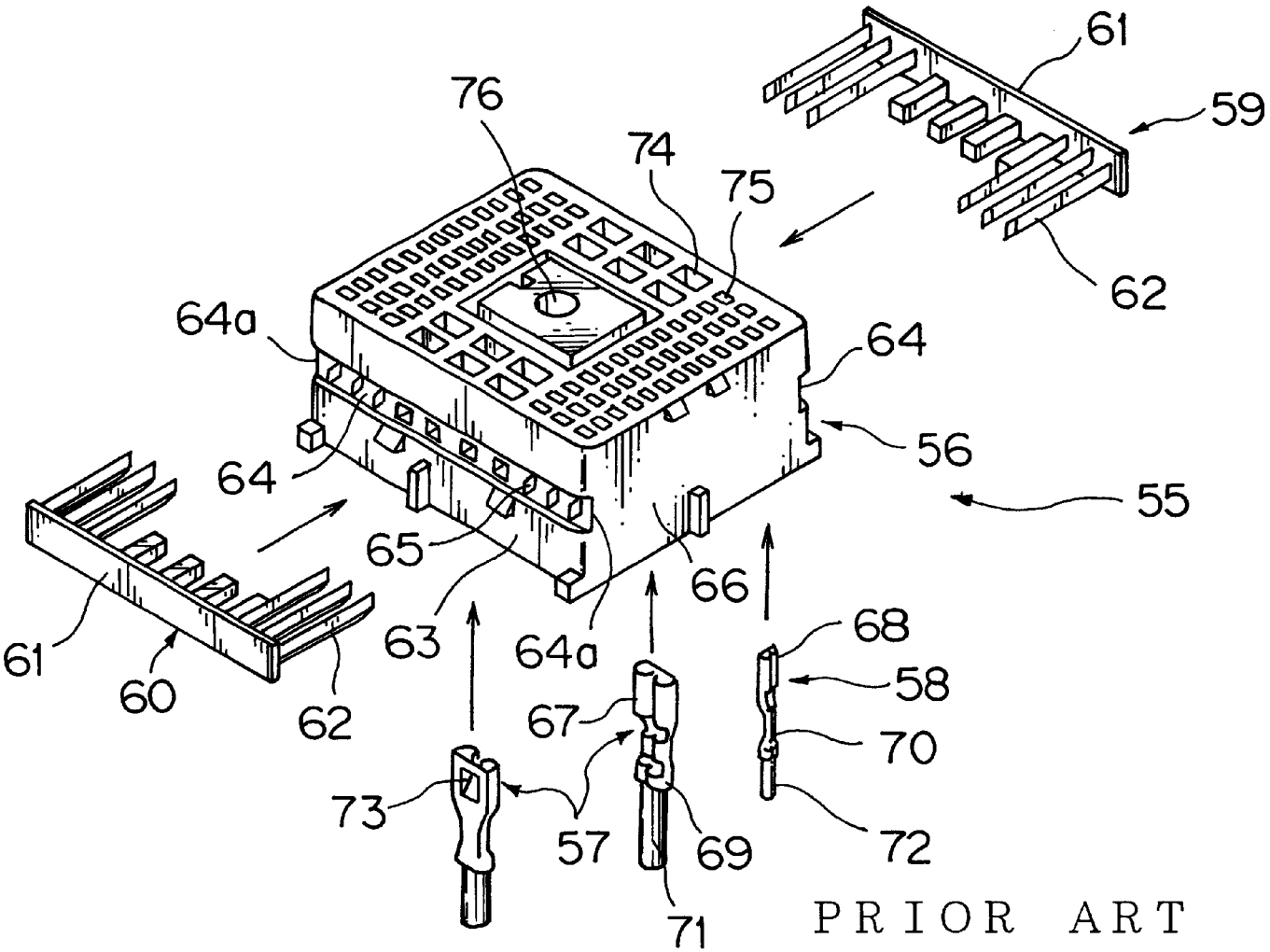
PRIOR ART FIG. 6
FIG. 6 is an exploded perspective view showing a conventional double lock connector.
Figure 7:
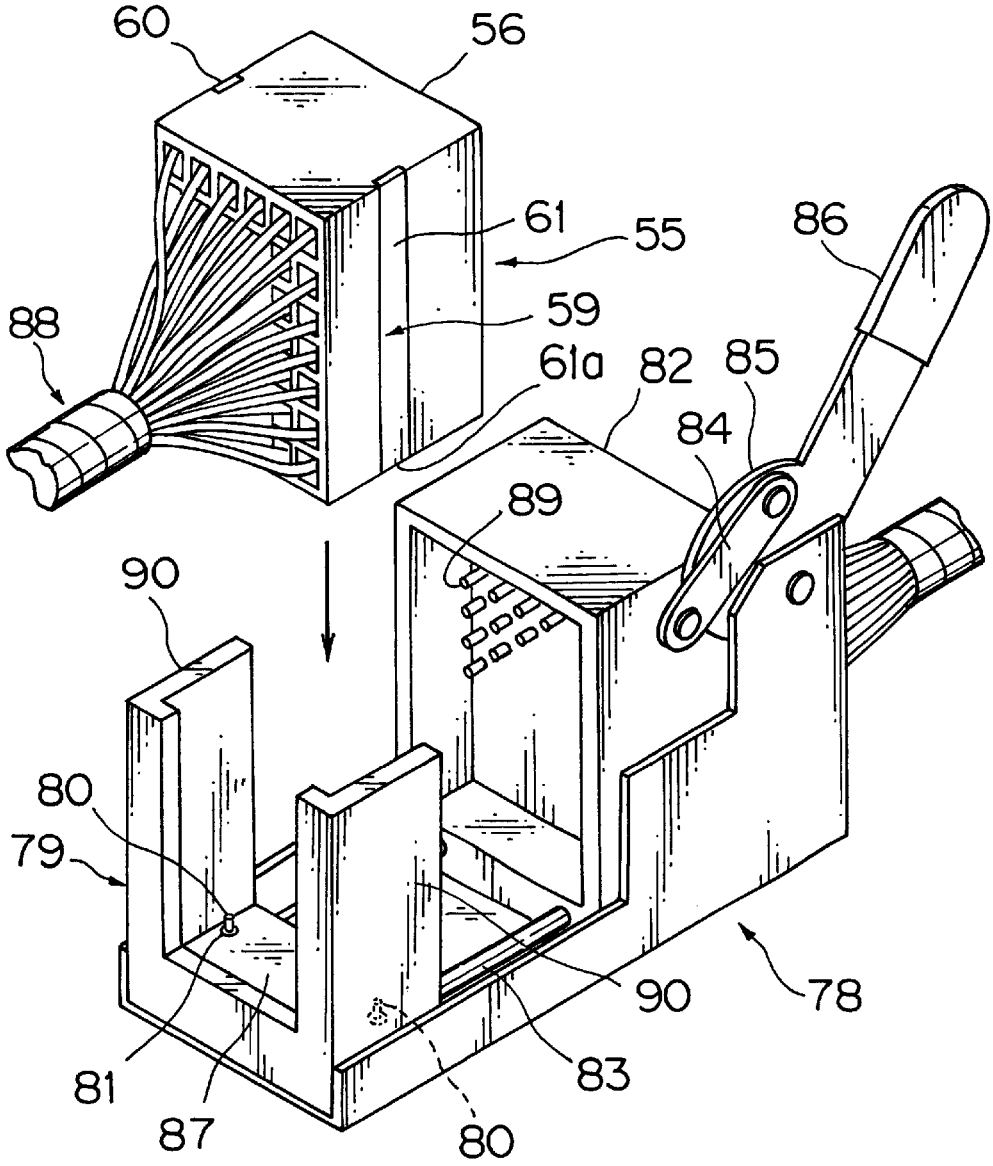
PRIOR ART FIG. 7
FIG. 7 is an exploded perspective view showing a spacer detecting method of the conventional double lock connector.

Because the frame-like portions 18 are formed integrally with the circumferences of the respective accommodating recesses 13,14 and therefore reinforcing portions 18*c*,18*d* are left on the sidewalls 11,12 differently from the conventional sidewalls on which the accommodating grooves (FIG. 6) are formed, the rigidity of sidewalls 11,12 is enhanced and the thickness of sidewalls 11,12 can be thinner, thereby preventing the connector housing 2 from being enlarged. And, because the length of the base plate portions 9,10 of the spacers 3,4 can be smaller, the spacer 3,4 can be downsized and light-weighted. The frame-like portion 18 is formed of back-and-forth long horizontal portions 18*a*,18*b* and right-and-left short vertical portions (i.e. reinforcing portions) 18*c*,18*d*. The slits 16,17 for spacer detection are formed in a state of crossing the respective front horizontal portions 18*a*.

The depth of the accommodating recesses 13,14 is the same as the thickness of the base plate portions 9,10 of the spacers 3,4. When the spacers 3,4 are set on the connector housing 2, the base plate portions 9,10 engage the accommodating recesses 13,14. The base plate portions 9,10 are positioned orthogonally to the respective slits 16,17, and end faces 9*a*,10*a* (FIGS. 1,3) of the base plate portions 9,10 act as respective abutting surfaces against later-described detecting pins.

A cover (not illustrated) is coveringly-provided on the back, i.e. the electric wire leading-out side, of the connector housing 2, and the electric wires 7,8 are led out from an opening of the cover.

Figure 3:
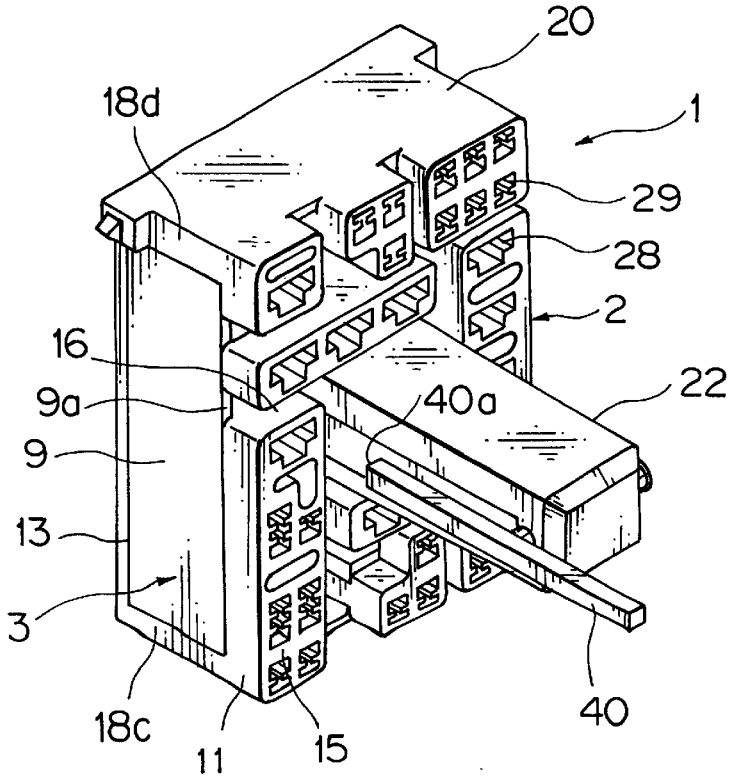
FIG. 3 is a perspective view showing a method for detecting a spacer of the double lock connector.

FIG. 3 is a perspective view showing a method for detecting the spacer 3 by means of the detecting pin 40. The detecting pin 40 is inserted into the slit 16 from the front end surface (i.e. a connector coupling side) 15 side of the connector housing 2 on which the terminals 5,6 (FIG. 1) and the spacers 3,4 (FIG. 1) have been set, and an end 40*a* of the detecting pin 40 abuts against the end face 9*a* of the base plate portion 9 of the spacer 3. The detecting pin 40 is perpendicularly inserted into the front end surface 15 of the connector housing 2. The detecting pin 40 with, for example, a square cross-section with a side of 2 mm is used, and an electric detection switch (not illustrated) is attached to a rear end of the detecting pin 40.

Figure 4:
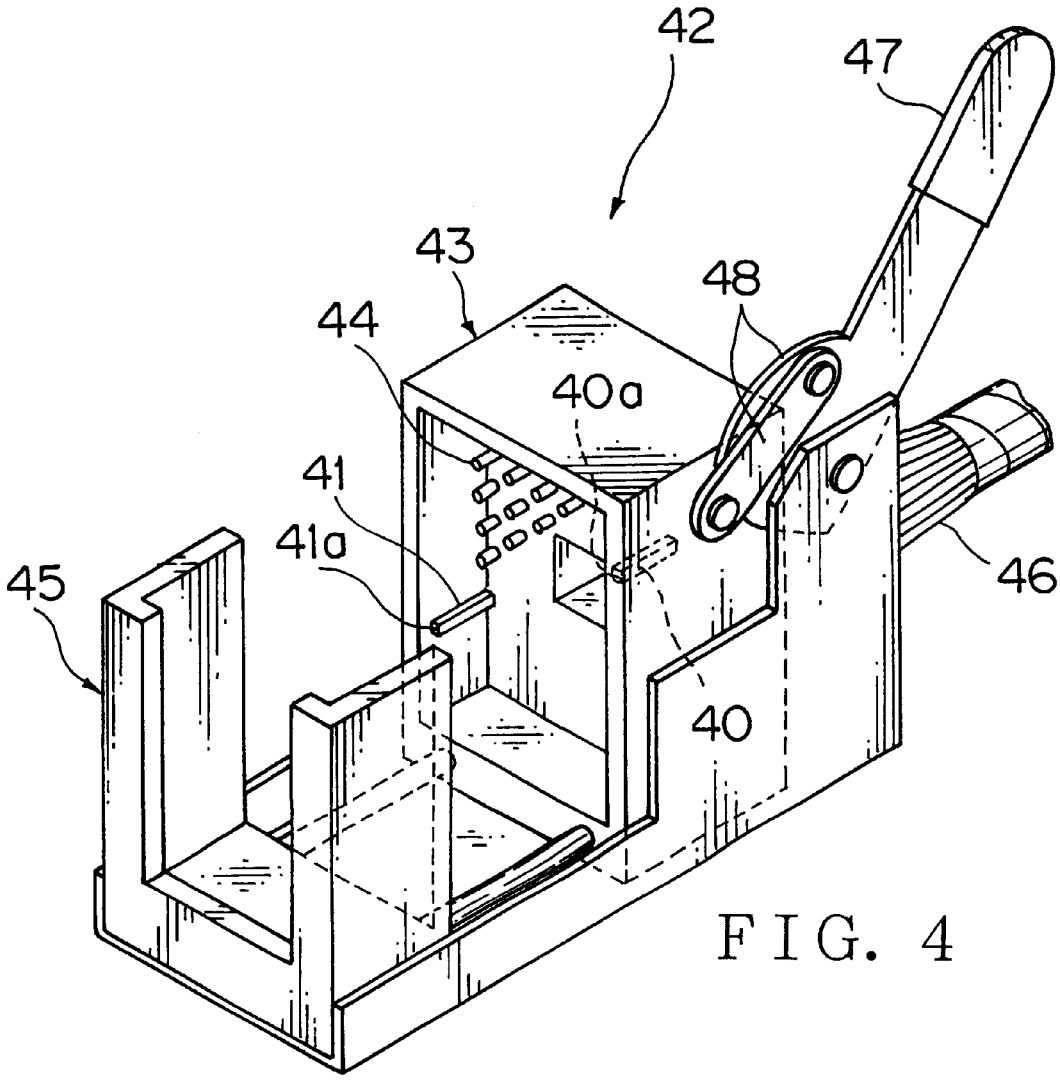
FIG. 4 is a perspective view showing an embodiment of a terminal continuity testing member having spacer detecting pins.

FIG. 4 is a perspective view showing an embodiment of a terminal continuity testing member 42 having spacer detecting pins 40,41. Because a basic structure of the terminal continuity testing member 42 is similar to the prior art, detailed description is omitted.

The detecting pins 40,41 are arranged inside the continuity testing portion 43 along with a plurality of terminal detecting pins 44. More specifically, the detecting pin 40 for the spacer 3 (FIG. 3) is arranged at a side of the continuity testing portion 43, and the detecting pin 41 for the spacer 4 (FIG. 1) is arranged at another side thereof. The detecting pins 40,41 are positioned a little outside the terminal detecting pins 44.

The detecting pins 40,41 are pushed by respective coil springs (not illustrated) and project toward the connector holding portions 45 so that the detecting pins 40,41 can longitudinally move by about 1 mm when the ends of the detecting pins 40,41 abut against the end face 9*a*, 10*a* of the base plate portions 9,10 of the spacers 3,4 (FIG. 1). The detecting pins 40,41 each are a part of each of the detection switches which are accommodated in the continuity testing portion 43 and connected to a displaying portion (not illustrated) with lead wires 46, similarly to the terminal detecting pins 44.

Figure 5:
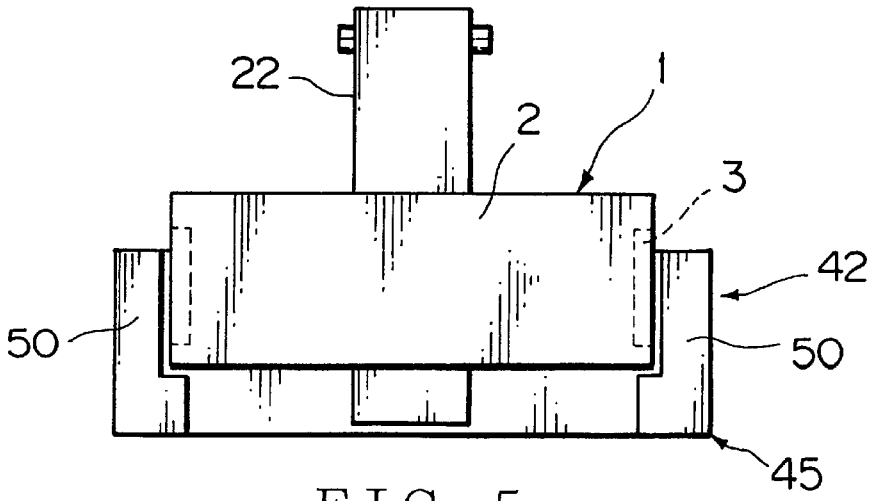
FIG. 5 is a plan view showing a state that the double lock connector is set in a connector holding portion of the terminal continuity testing member.

The connector 1 is set in a connector holding portion 45 as shown in FIG. 5, and subsequently an operation lever 47 shown in FIG. 4 is turned forward to shift the continuity testing portion 43 forward by means of advance a link mechanism 48 so that the continuity testing portion 43 is connected to the connector 1. By this, the terminal detecting pins 44 are inserted into the front openings 28,29 of the connector housing 2 (FIG. 3) and abut against the electrically contacting portions 30,31 of the terminals 5,6 (FIG. 1). And, the detecting pins 40,41 are inserted into the slits 16,17 (FIG. 1) of the connector housing 2 and abut against the end faces 9*a*,10*a* of the base plate portions 9,10 of the spacers 3,4. With this state, the continuity of the terminals 5,6 is tested, and the presence of the spacers 3,4 is confirmed with on-signals from the detection switches connected to the detecting pins 40,41.

Whenever the spacers 3,4 are not set on the connector housing 2, the detecting pins 40,41 deeply enter the slits 16,17, which brings the detection switches to be off, while detecting the spacers 3,4 being not attached. And, of course, a lack of one of the spacers 3,4 can be detected.

Because the detecting pins 40,41 are arranged inside the continuity testing portion 43 differently from the prior art connector in which the detecting pins are arranged on the connector holding portion 45, the connector holding portion 45 is simplified, downsized, and light-weighted, and therefore the terminal continuity testing member 42 itself is downsized, light-weighted, and cost-reduced. And, because detection of the presence of the spacers 3,4 can be carried out simultaneously with a continuity test of the terminals 5,6, setting work and testing work of the connector 1 are facilitated.

Also, as shown in FIG. 3, the detecting pin 40 is arranged oppositely to the front end surface 15 of the connector housing 2, the presence of the spacer 3 is detected through the slit 16 from the front of connector 1, and the reinforcing portions 18*c*,18*d* are provided on both sides of each of the spacer accommodating recesses 13,14, whereby the rigidity of the connector housing 2 is enhanced and the connector housing 2 is downsized.

Further, when the connector 1 is set on the connector holding portion 45 of the terminal continuity testing member 42 as shown in FIG. 5, if the spacers 3,4 are in a incompletely inserted state, the connector 1 can not be set thereon because the base plate portions 9,10 of the spacers 3,4 (FIG. 1) abut against upper end surfaces of auxiliary guides 50 of the connector holding portions 45. Therefore, incomplete insertion of the spacers 3,4, can also be detected. This is also applicable to a case wherein only one spacer is incompletely inserted.

In the above, embodiment, though the slits 16,17 are formed as the detecting pin inserting portions of the connector housing 2, holes as the detecting pin inserting portions can be formed in place of the slits 16,17. And, slits or holes as the detecting pin inserting portions may be provided orthogonally to the detecting rod insertion holes 19,36.

In this case, the ends of the detecting pins 40,41 abut against the engaging rods 34,35A,35B thereby to detect the spacers. Whenever the spacers are not set, the ends of the detecting pins 40,41 deeply enter the insertion holes 19,36, while the detection switches remain to be off, thereby detecting the spacers being not set.

Otherwise, if the detecting pin inserting portions are provided at the end portions, i.e. the deepest portion, of the insertion holes 19,36 orthogonally thereto, the incomplete insertion of the spacers 3,4 can be detected since the ends of the detecting pins 40,41 do not abut against the front end portions of the engaging rods 34,35A,35B without providing the auxiliary guides 45 on the terminal continuity testing member 42.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A double lock connector comprising:

a connector housing having a terminal accommodating chamber and a front opening continuing to the terminal accommodating chamber;

a terminal to be inserted into the terminal accommodating chamber; and a spacer for engaging the terminal and to be inserted into the connector housing in a direction crossing a terminal inserting direction, wherein a detecting pin inserting portion, continuing from a front surface of the connector housing to the spacer inserted into the connector housing, and continuing to a side surface of the connector housing, is provided on the connector housing.

2. The double lock connector as set forth in claim 1, wherein the detecting pin inserting portion is of a slit.

3. A double lock connector comprising:

a connector housing having a terminal accommodating chamber and a front opening continuing to the terminal accommodating chamber;

a terminal to be inserted into the terminal accommodating chamber; and a spacer for engaging the terminal and to be inserted into the connector housing in a direction crossing a terminal inserting direction, wherein a detecting pin inserting portion, continuing from a front surface of the connector housing to the spacer inserted into the connector housing, is provided on the connector housing, the spacer is provided with a base plate portion, the connector housing is provided with an accommodating recess to accommodate the base plate portion, and the detecting pin inserting portion continues to the accommodating recess.

4. A double lock connector comprising:

a connector housing having a terminal accommodating chamber and a front opening continuing to the terminal accommodating chamber;

a terminal to be inserted into the terminal accommodating chamber; and a spacer for engaging the terminal and to be inserted into the connector housing in a direction crossing a terminal inserting direction, wherein a detecting pin inserting portion in the form of a slit, continuing from a front surface of the connector housing to the spacer inserted into the connector housing, is provided on the connector housing, the spacer is provided with a base plate portion, the connector housing is provided with an accommodating recess to accommodate the base plate portion, and the detecting pin inserting portion continues to the accommodating recess.

5. The double lock connector as set forth in claim 3, wherein the connector housing is provided with a pair of said accommodating recesses and a pair of said detecting pin inserting portions continuing to the respective accommodating recesses.

6. The double lock connector as set forth in claim 4, wherein the connector housing is provided with a pair of said accommodating recesses and a pair of said detecting pin inserting portions continuing to the respective accommodating recesses.

* * * * *